US006495764B1

(12) United States Patent
Hori

(10) Patent No.: US 6,495,764 B1
(45) Date of Patent: Dec. 17, 2002

(54) SHIELDED FLAT CABLE

(75) Inventor: Shigeru Hori, Tokyo (JP)

(73) Assignee: Yamaichi Electronics Co., Ltd., Tokyo (JP)

( * ) Notice: Subject to any disclaimer, the term of this patent is extended or adjusted under 35 U.S.C. 154(b) by 0 days.

(21) Appl. No.: 09/869,718

(22) PCT Filed: Nov. 9, 2000

(86) PCT No.: PCT/JP00/07891

§ 371 (c)(1),
(2), (4) Date: Jul. 3, 2001

(30) Foreign Application Priority Data

Nov. 9, 1999 (JP) ..... 11-318751

(51) Int. Cl.[7] ..... H01B 7/08
(52) U.S. Cl. ..... 174/117 F
(58) Field of Search ..... 174/117 F, 117 FF, 174/36, 250

(56) References Cited

U.S. PATENT DOCUMENTS 4,912,283 A * 3/1990 O'Connor ..... 174/105 R
5,917,154 A 6/1999 Mortier ..... 174/117 FF

FOREIGN PATENT DOCUMENTS

JP 2-146713 12/1990

* cited by examiner

*Primary Examiner*—Chau N. Nguyen
(74) *Attorney, Agent, or Firm*—Oblon, Spivak, McClelland, Maier & Neustadt, P.C.

(57) ABSTRACT

A shielded flat cable including an insulating layer that includes liquid crystal polymer and is folded in two or three to integrate, and signal and ground wirings integrally disposed insulated from each other on a folded surface of the insulating layer, a shield layer disposed integrally on an external surface of the insulating layer and covering a disposition area of the signal and ground wirings, and a conducting portion piercing through the insulating layer and connecting electrically the ground wiring with the shield layer. By thus configuring, a shielded flat cable can be simplified in its structure and have shielding properties of high reliability.

8 Claims, 3 Drawing Sheets

FIG. 1
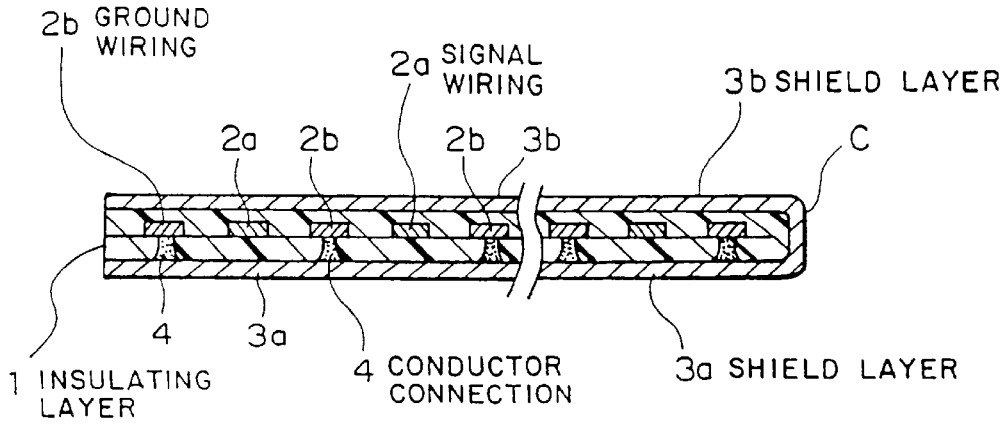
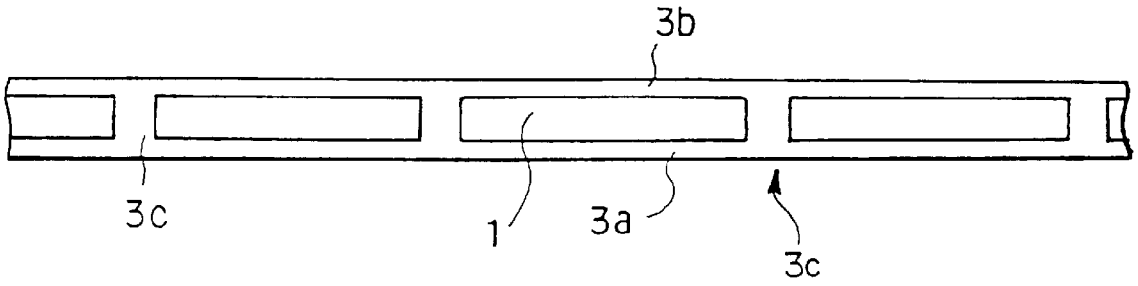
FIG. 2

SHIELDED FLAT CABLE

TECHNICAL FIELD

The present invention relates to a shielded flat cable in which effective countermeasure is taken to reduce noise levels of high frequency signals.

BACKGROUND ART

High frequency oscillators, for instance, require miniaturization with an increase of miniaturization of electronic apparatuses or the like. To such requirements, a shielded flat cable in which signal wirings (strip lines) are disposed and insulated from each other between insulating layers has been developed. When the signal wirings are formed between the insulating layers (internally formed), there is a likelihood that generated signal radiation adversely affects other signal wirings. In addition, an influence of an external electromagnetic noise may cause a malfunction in a wiring circuit including the signal wiring.

To deal with such problems, a configuration of a shielded flat cable is proposed. In the configuration, insulating and shield layers are concentrically stacked with each signal wiring to form a shield wire. Thereafter, the shield wires are disposed in parallel and covered by an insulator to integrate, thereby forming a shielded flat cable. The signal wiring (center conductor) is made of tin plated annealed copper wire or silver plated copper alloy wire, and the shield layer is made of a mesh of tin plated annealed copper wires. Furthermore, the aforementioned shield wires are arranged in parallel with a pitch of approximately 1.27 mm, followed by covering with an insulating layer of such as polyvinyl chloride resin to integrate with a thickness of approximately 2 mm.

Though the shielded flat cable mentioned above has an ability of reducing an adverse influence due to the signal wirings, there are still the following problems. That is, even in this kind of shielded flat cable, higher densification or finer patterning of signal wirings is required to provide greater compactness or higher functionality of the circuit.

However, in making the circuit more compact or denser, more complicated machine operations, and finer and more precise machining or the like are necessitated, thereby tending to result in a remarkable increase of the manufacturing costs or decrease of reliability. In other words, in the manufacture and formation of the aforementioned shield wirings, there is a limit in dimensional accuracy in the parallel arrangement of the shield wirings and in the covering and integration with the insulating layer. As a result, the densification is largely restricted.

As a means for stabilizing the signal wirings disposed inside the insulating layer, there is proposed the following configuration. That is, in the configuration the signal wirings are arranged sandwiched in plane between ground wirings, and are sandwiched from above and below between a pair of shield layers. In addition, the ground wiring and shield layer are electrically connected by means of a vertical shield conductor (via interconnection).

One shield layer is a grounding layer made of copper foil disposed integrally on the other main surface of the insulating layer on which the signal and ground wirings are disposed. The other shield layer is a conductive paste layer or the like disposed integrally on the other main surface of the insulating layer covering the signal wirings. However, in the configuration where the signal and ground wirings are sandwiched from right to left in plane and from above and below, the following operations are prerequisite. That is, when vertically connecting the ground wiring with the shield layer by means of a wiring conductor, it is suggested to bore in advance, at a corresponding position, a necessary hole by drilling, followed by the formation of a conductor layer or the like inside the hole.

In boring by means of a drill, a small diameter of approximately several hundreds $\mu$m is a lower limit to bore. This small diameter not only becomes an obstacle in higher densification and miniaturization of the signal wirings or the like, but also exerts a large adverse influence on yield or the like, resulting in an increase of manufacturing cost. A small hole of approximate 300 $\mu$m can be bored by means of laser machining in place of the boring due to the drilling. However, it is difficult to form a connection of high reliability through the hole.

The present invention is carried out in view of the aforementioned situations. The object of the present invention is to provide a shielded flat cable that has a simplified structure and high shielding reliability, and a manufacturing method thereof.

DISCLOSURE OF THE INVENTION

A first aspect of the present invention is a shielded flat cable, comprising an insulating layer that comprises liquid crystal polymer and is folded and stacked integrally, signal wirings disposed on a folded surface of the insulating layer and ground wirings disposed thereon, the signal wirings and the ground wirings being insulated from each other, a shield layer integrally disposed on an external surface of the insulating layer to cover a disposition area of the signal wirings and ground wirings, and a conducting portion piercing through the insulating layer to connect electrically the ground wiring with the shield layer.

In the shielded flat cable of the present invention, the shield layer may be excised at a plurality of positions corresponding to a fold area of the insulating layer.

A second aspect of the present invention is a manufacturing method of a shielded flat cable, comprising the steps of forming a wiring base substrate in which signal wirings and ground wirings are disposed and insulated from each other on one side area or a center area of one main surface of an insulating layer comprising liquid crystal polymer, and a conductive foil layer connected with the ground wiring which is disposed on the other main surface of the insulating layer, folding the wiring base substrate along the outside of a disposition area of the respective wirings so that a non-disposition area of the respective wirings faces the disposition area thereof, and bonding integrally opposing surfaces of the folded wiring base substrate to make the conductive foil layer a shield layer.

A third aspect of the present invention is a manufacturing method of a shielded flat cable, comprising the steps of, forming signal wirings and ground wirings insulated from each other on one side area or a center area of one main surface of an insulating layer comprising liquid crystal polymer, aligning a conductive foil layer having a conductive protrusion capable of connecting with the ground wiring on the other main surface of the insulating layer, and stacking to form a stacked body, compressing the stacked body integrally to bring the conductive protrusion into piercing through the insulating layer and electrical contact with the ground wiring, and forming a wiring base substrate, folding the wiring base substrate along the outside of a disposition area of the wirings of the insulating layer so that a non-disposition area of the wirings faces the disposition area thereof, and bonding integrally opposing surfaces of the folded wiring base substrate to make the conductive foil layer a shield layer.

In the manufacturing method of the shielded flat cable of the present invention, an insulating adhesive layer may be interposed between the opposing surfaces in the step of bonding integrally.

A part of the conductive foil layer corresponding to a fold area of the insulating layer may be excised in the step of bonding integrally.

In the present invention, the signal wiring, ground wiring and shield layer are composed of conductive metal such as copper, aluminum or the like and is generally formed in foil or thin film of a thickness of approximately from 12 to 35 μm. The signal wiring, ground wiring and shield layer are formed by patterning a copper foil of a copper clad liquid crystal polymer film for instance.

In general, widths of the signal and ground wirings are in the range of approximately 110 to 120 μm and a distance (pitch) between the signal wiring and the ground wiring is also in the range of approximately 110 to 120 μm. For the disposition area of the signal wiring and the ground wiring, in the case of the insulating layer being folded in two, one area (single side area) of two areas is selected. In the case of the insulating layer being folded in three, a center area of three areas is selected. However, in the above division, the folded non-disposition area need only be sufficiently large to correspond to the wiring disposition area. In this meaning, strict two or three division is not meant.

Furthermore, the shield layer for shielding an area where the signal wiring and the ground wiring are disposed is formed by folding a sheet of conductive foil layer or thin layer. That is, at least one external edge periphery in a length direction of one shield layer is extended and the extended portion is folded to form opposing shield layers, thereby a necessary shield potential being maintained.

Specifically, by setting for the width of the insulating layer to exceed two times the width of the wiring disposition area and by disposing the conductive foil layer or the like over an opposing surface to the surface on which the wirings are formed, a wiring base substrate is formed. The non-disposition area is folded with the conductive foil layer disposed outside. Thereby, the wiring disposition area is covered by and integrated with the wiring non-disposition area through the insulating layer. The opposing surfaces of the folded insulating layer may be integrated due to thermal fusion of the liquid crystal polymer forming the insulating layer. By interposing an adhesive resin layer of coating type or film type of epoxy resin or the like, the integration can be implemented more easily. The shield layer, in the case of folding in three, is preferable to be disposed over an entire circumference of the wiring disposition area. However, in the case of folding in two, the shield layer may be excised in a narrow band shape in one side of the wiring disposition area (next to the ground wiring).

When folding integrally the insulating layer and the conductive foil layer (shield layer), the excision of part of the conductive foil layer corresponding to the fold area, that is a center portion in a folding direction, improves the folding property of the shielded flat cable. The partial excision of the conductive foil layer is appropriately implemented within the range capable of maintaining electrical continuity of the conductive foil layer.

In the present invention, for the insulating layer in which the signal and ground wirings and conductors for connecting the ground wiring with the shield layer are internally disposed, liquid crystal polymer is used. That is, the liquid crystal polymer, being almost non-hygroscopic, approximately 3.0 (1 MHz) in dielectric constant and stable in a broad frequency range, is suitable for high frequency cables.

The liquid crystal polymer is multi-axially oriented thermoplastic polymer typical in for instance XYDAR (Product Name of Dartco Co.,) and VECTRA (Product Name of Clanese Co.,). Other insulating resin may be added or compounded to the liquid crystal polymer to be denatured. A film thickness thereof (thickness of insulating layer) is in the range of 30 to 100 μm for instance.

The liquid crystal polymer is different in its melting point or the like due to its molecular structure. Even under the same molecular structure, due to the crystal structure or additives, the melting point varies. For instance, Bectran A (Products of KK Kurare. Melting point: 285° C.), Bectran C (Products of KK Kurare. Melting point: 325° C.), BIAC film (Products of Japan Goatex Co. Ltd. Melting point: 335° C.) or the like can be cited.

In the embodiments of the present invention, since the signal and ground wirings are integrated with the shield layer, the shielded flat cable is compactly structured and simplified in the manufacturing process. Furthermore, since mechanical and electrical connections can be assuredly secured with ease, they function as the shielded flat cable for high frequency having shielding property of high reliability.

In the inventions set forth in claims 3 through 6, while simplifying the manufacturing process and saving labor therein, the shielded flat cable for high frequency with high reliability can be provided with ease and high yield.

BRIEF DESCRIPTION OF THE DRAWINGS

FIG. 1 is a sectional view showing a structure of a shielded flat cable involving a first embodiment.

FIG. 2 is a side view of a shielded flat cable shown in FIG. 1.

THE BEST MODE FOR IMPLEMENTING THE INVENTION

Figure 3A:
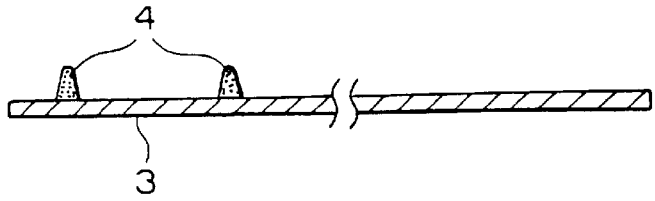
FIGS. 3A, 3B, 3C and 3D are sectional views showing schematically in order of steps an implementation mode in the manufacture of a shielded flat cable involving a first embodiment.

Embodiments will be explained with reference to FIGS. 1, 2, 3A through 3D, and 4A through 4D.

Embodiment 1

FIGS. 1 and 2 are diagrams showing structures of a shielded flat cable involving the present embodiment, FIG. 1 being a sectional view, FIG. 2 being a side view. In FIGS. 1 and 2, reference numeral 1 denotes an insulating layer that comprises liquid crystal polymer and is integrated after folding in two. The insulating layer 1 is a layer (film) of liquid crystal polymer of a thickness of for instance 50 μm and is folded in two along an approximate center C of a width direction. On an opposing surface of the insulating layer 1 when folding, signal wirings 2*a* and ground wirings 2*b* of a thickness of approximately 12 to 18 μm and a width of approximately 110 to 120 μm are integrally disposed insulated from each other (with a separation of approximately 110 to 120 μm).

Furthermore, reference numerals 3*a* and 3*b* denote a shield layer that is integrally disposed on an external surface of the insulating layer 1 and covers a disposition area of the signal and ground wirings 2*a* and 2*b*. Reference numeral 4 denotes a conductor connection that penetrates through the insulating layer 1 to connect electrically the ground wiring 2*b* with the shield layer 3*a*. In FIG. 2, a part of the center portion of a fold area is excised and the shield layers 3*a* and 3*b* are connected at both edge portions 3C in a length direction. However, the above excised portion can be arbitrarily selected and when the flexibility is not important, the excision is not necessary in the fold area.

In the shielded flat cable, terminals are lead out (exposed) in both edges of main surfaces in its length direction so that connectors or the like are connected thereto respectively.

Next, an example of the manufacturing method of the shielded flat cable configured as mentioned above will be explained.

FIGS. 3A, 3B, 3C and 3D are sectional views showing schematically in order of steps an implementation mode of a manufacturing process. First, a copper foil 3 of a thickness of 18 $\mu$m is prepared. In a side area of one main surface of the copper foil 3, a screen (stencil screen) is aligned to screen print conductive paste, followed by drying, to form, as shown in FIG. 3A, conductive protrusions (conductive connections) 4 at prescribed positions.

Figure 3B:
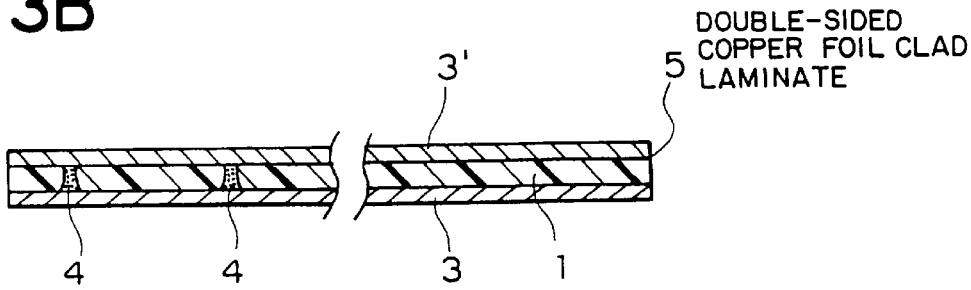

Following this, on the surface of the copper foil 3 on which the conductive protrusions 4 are formed, a sheet of liquid crystal polymer 1 formed in a shape approximately identical with that of the copper foil 3 and having a thickness of 50 $\mu$m, and a copper foil 3' of a thickness of 18 $\mu$m are disposed to stack. Thereafter, the stacked body is compressed under heating to form a double-sided copper foil clad laminate (sheet) 5 as shown in FIG. 3B. The double-sided copper foil clad laminate (sheet) 5 has two areas. One (single side area) of two areas is the area in which the conductive protrusion 4 piercing through the sheet of liquid crystal polymer 1 reaches an opposing surface of copper foil 3' to bring both copper foils 3 and 3' into electrical contact. In the other area, both copper foils 3 and 3' are not brought into electrical contact.

Figure 3C:
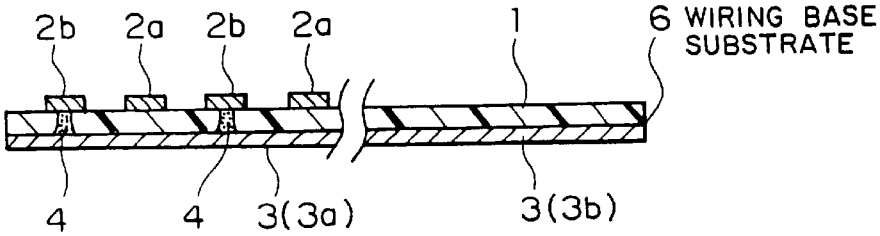

Subsequently, on the surface of the copper foil 3 and 3' of the double-sided copper foil clad laminate 5, an etching resist film is selectively formed. Thereafter, with an aqueous solution of ferric chloride for instance as an etching solution (etchant), the copper foil is etched to remove an unnecessary copper portion. In the selective etching (patterning), connection terminals are disposed to come into contact with an external circuit at both end portions of wirings. Thereafter, the etching resist film is removed. Thereby, as shown in FIG. 3C, the signal and ground wirings 2*a* and 2*b* are formed on one main surface of one (a side area) of the two areas, and the copper foil 3 is remained all over the entire surface on the other main surface. Thus, an wiring base substrate 6 is formed.

Figure 3D:
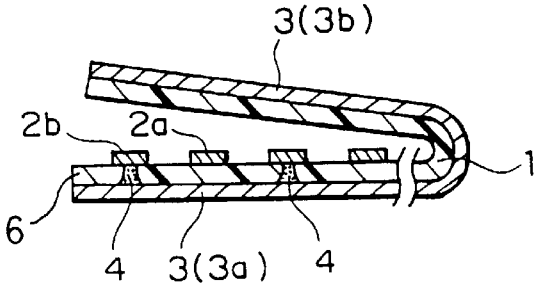

Next, the wiring base substrate 6 is folded in two at a position that divides the wiring base substrate 6, as shown in FIG. 3D, between one area (disposition area) where the signal and ground wirings 2*a* and 2*b* are formed (disposed) and the other area (non-disposition area) where these wirings are not formed, followed by compressing under heating. Due to the compression under heating, opposing insulating layers 1 are mutually fused to integrate the surface on which the wirings 2*a* and 2*b* are formed and the surface on which the wirings 2*a* and 2*b* are not formed. Thereby, a shielded flat cable such as shown in FIG. 1 can be obtained.

In the step of bonding/integrating, between the surface where the wirings 2*a* and 2*b* are formed and the surface where those are not formed, in other words, in an interface where the above both surfaces are bonded/integrated, an adhesive layer 6 of coating type or film type epoxy resin may be interposed. In that case, bonding with high reliability can be made with ease.

In the shielded flat cable configured as mentioned above, high frequency characteristics are more stabilized in accordance with the insulating layer 1 being formed of liquid crystal polymer having low dielectric constant. In addition, the shielded flat cable is thinner and more compact and shows a function of higher reliability due to low moisture absorption characteristics and excellent flexibility.

Embodiment 2

Figure 4A:
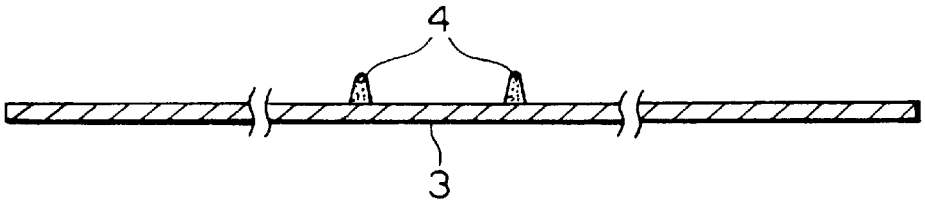
FIGS. 4A, 4B, 4C and 4D are sectional views showing schematically in order of steps an implementation mode in the manufacture of a shielded flat cable involving a second embodiment.

FIGS. 4A, 4B, 4C and 4D are sectional views showing schematically in order of steps an implementation mode of another example of a manufacturing process of a shielded flat cable. First, a copper foil 3 of a thickness of 18 $\mu$m is prepared. In an approximate center area of one main surface of the copper foil 3, a screen (stencil screen) is aligned to screen print conductive paste, followed by drying, to form, as shown in FIG. 4A, conductive protrusions (conductive connections) 4 at prescribed positions.

Figure 4B:
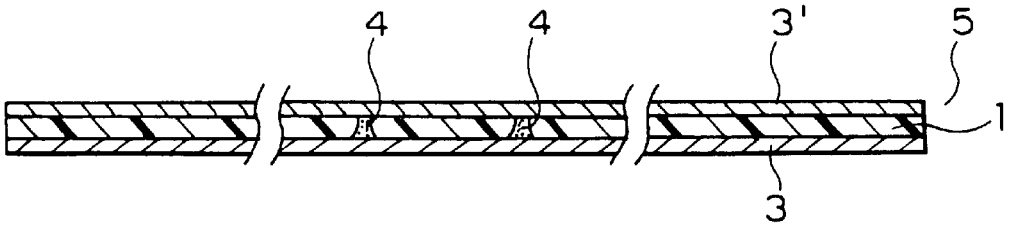

Following this, on the surface of the copper foil 3 on which the conductive protrusions 4 are formed, a sheet of liquid crystal polymer 1 formed in a shape approximately identical with that of the copper foil 3 and having a thickness of 50 $\mu$m, and a copper foil 3' of a thickness of 18 $\mu$m are disposed to stack. Thereafter, the stacked body is compressed under heating to form a double-sided copper foil clad laminate (sheet) 5 as shown in FIG. 4B. The double-sided copper foil clad laminate (sheet) 5 has three areas. One of three areas is an approximate center area where the conductive protrusion 4 piercing through the sheet of liquid crystal polymer 1 reaches an opposing surface of the copper foil 3' to bring both copper foils 3 and 3' into electrical contact. The other two areas outside the above center area are areas where both copper foil 3 and 3' are not brought into electrical contact.

Figure 4C:
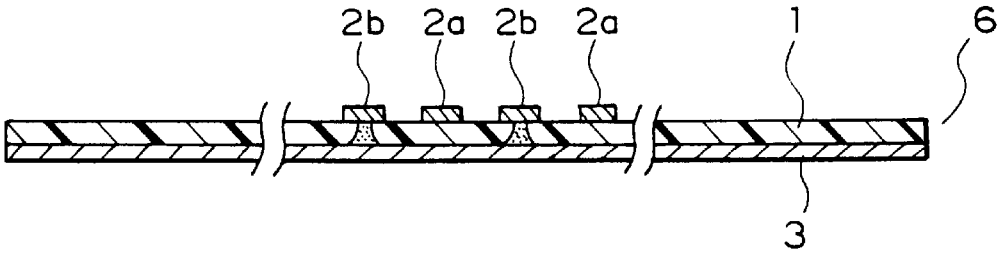

Subsequently, on the surface of the copper foil 3 and 3' of the double-sided copper foil clad laminate 5, an etching resist film is selectively formed. Thereafter, with an aqueous solution of ferric chloride for instance as an etching solution (etchant), the copper foil is etched to remove an unnecessary copper portion. In the selective etching (patterning), connection terminals are disposed to come into contact with an external circuit at both end portions of wirings. Thereafter, the etching resist film is removed. Thereby, an wiring base substrate 6, as shown in FIG. 4C, is formed. In the wiring base substrate 6, the signal and ground wirings 2*a* and 2*b* are formed on the center area of the three areas and the copper foil 3 remains all over the entire surface on the other main surface.

Figure 4D:
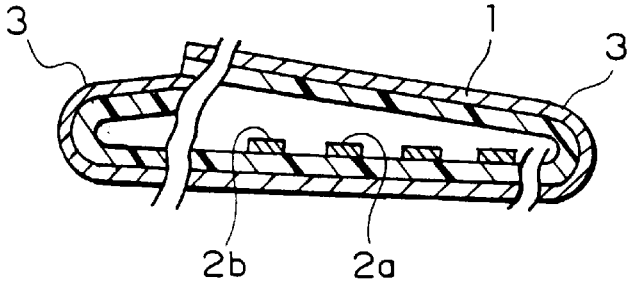

Next, the wiring base substrate 6 is folded in three at a position that divides the wiring base substrate 6, that is, between one area (disposition area) where the signal and ground wirings 2*a* and 2*b* are formed (disposed) and other two areas (non-disposition areas) where these wirings are not formed, as shown in FIG. 4D, followed by compressing under heating. Due to the compression under heating, opposing insulating layers 1 are fused to integrate the surface on which the wirings 2*a* and 2*b* are formed and the surface on which the wirings 2*a* and 2*b* are not formed. Thereby, a shielded flat cable in which the area where the wirings 2*a* and 2*b* are formed is covered by the copper foil 3 over an entire circumference of the area can be obtained.

In the step of bonding/integrating, between the surface where the wirings 2*a* and 2*b* are formed and the surface where those are not formed, in other words, in an interface where the above both surfaces are bonded/integrated, an adhesive layer of coating type or film type epoxy resin may be interposed. In that case, bonding with high reliability can be made with ease.

In the shielded flat cable configured as mentioned above, in particular in accordance with the area where the wirings 2*a* and 2*b* are formed being covered by the copper foil 3 all over an entire circumference thereof, an sealing effect can be improved. Furthermore, due to the insulating layer 1 comprising the liquid crystal polymer having low dielectric constant, high frequency characteristics can be stabilized. In addition, due to low moisture absorption characteristics and excellent flexibility, the shielded flat cable can be made thinner and more compact and shows a function of higher reliability.

The present invention is not restricted to the above embodiments, within a range not deviating from the scope of the invention, various modifications can be applied. For instance, material and film thickness of liquid crystal polymer that forms an insulating layer, material of signal and ground wirings and shield layer, thickness and width of the respective wirings, and pitch distance of the respective wirings can be appropriately selected and set.

Industrial Applicability

According to the inventions set forth in claim 1 and 2, a necessary sealing is implemented due to electrical connection of the ground wiring and shield layer with respect to the signal wiring, and furthermore due to the folding of an integrated shield layer. Furthermore, the liquid crystal polymer that is an insulating layer is low in dielectric constant, excellent in high frequency characteristics, almost non-hygroscopic to be stable in its function, and does not require high machining precision. As a result, the flexible shielded flat cable of low cost and high reliability is provided and performance of such as a high frequency signal circuit is improved.

According to the inventions set forth in claims 3 through 6, the shielded flat cable facilitating to improve the high frequency circuit can be provided with high yield and good mass-productivity without requiring complicated processes.

What is claimed is:

1. A shielded flat cable, comprising:

an insulating layer that comprises liquid crystal polymer and is folded and stacked integrally;

a signal wiring disposed on a folded surface of the insulating layer and a ground wiring disposed on said folded surface of the insulating layer, the signal wiring and the ground wiring being insulated from each other;

a shield layer integrally disposed on an external surface of the insulating layer to cover a disposition area of the signal wiring and the ground wiring; and a conducting portion piercing through the insulating layer to connected electrically the ground wiring with the shield layer.

2. The shielded flat cable as set forth in claim 1:

wherein the shield layer is excised at a plurality of positions corresponding to a fold area of the insulating layer.

3. A manufacturing method of a shielded flat cable, comprising the steps of:

forming a wiring base substrate in which a signal wiring and a ground wiring are disposed insulated from each other on one side area or a center area of one main surface of an insulating layer comprising liquid crystal polymer, and a conductive foil layer connected with the ground wiring is disposed on the other main surface of the insulating layer;

folding the wiring base substrate along the outside of a disposition area of the signal wiring and the ground wiring so that a non-disposition area of the signal wiring and the ground wiring faces the disposition area thereof; and bonding integrally opposing surfaces of the folded wiring base substrate to make the conductive foil layer a shielded layer.

4. The method of manufacturing a shielded flat cable as set forth in claim 3:

wherein an insulating adhesive layer is interposed between the opposing surfaces in the step of bonding integrally.

5. The method of manufacturing a shielded flat cable as set forth in claim 3:

wherein a part of the conductive foil layer corresponding to a fold area of the insulating layer is excised in the step of bonding integrally.

6. A manufacturing method of a shielded flat cable, comprising the steps of:

forming a signal wiring and a ground wiring insulated from each other on one side area or a center area of one main surface of an insulating layer comprising liquid crystal polymer;

aligning a conductive foil layer having a conductive protrusion capable of connecting with the ground wiring on the other main surface of the insulating layer, and stacking to form a stacked body;

compressing the stacked body integrally to bring the conductive protrusion into piercing through the insulating layer and electrical contact with the ground wiring, and forming a wiring base substrate;

folding the wiring base substrate along the outside of a disposition area of the signal wiring and the ground wiring of the insulating layer so that a non-disposition area of the signal wiring and the ground wiring faces the disposition area thereof; and bonding integrally opposing surfaces of the folded wiring base substrate to make the conductive foil layer a shield layer.

7. The method of manufacturing a shielded flat cable as set forth in claim 6:

wherein an insulating adhesive layer is interposed between the opposing surfaces in the step of bonding integrally.

8. The method of manufacturing a shielded flat cable as set forth in claim 6:

wherein a part of the conductive foil layer corresponding to a fold area of the insulating layer is excised in the step of bonding integrally.

* * * * *